US010006734B1

(12) United States Patent
Findlay

(10) Patent No.: US 10,006,734 B1
(45) Date of Patent: Jun. 26, 2018

(54) TRIGGER ASSEMBLY WITH TRIGGER BLOCK

(71) Applicant: Smith & Wesson Corp., Springfield, MA (US)

(72) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days. days.

(21) Appl. No.: 15/466,060

(22) Filed: Mar. 22, 2017

(51) Int. Cl.
*F41A 19/00* (2006.01)
*F41A 19/10* (2006.01)
*F41A 19/12* (2006.01)

(52) U.S. Cl.
CPC ..... *F41A 19/10* (2013.01); *F41A 19/12* (2013.01)

(58) Field of Classification Search
CPC ..... F41A 19/10; F41A 19/12; F41A 17/46
See application file for complete search history.

(56) References Cited

U.S. PATENT DOCUMENTS 290,737 A 12/1883 Brown
5,105,569 A 4/1992 Straitiff
5,560,134 A 10/1996 Van Niekerk et al.
6,553,706 B1 4/2003 Gancarz et al.
6,843,013 B2 1/2005 Cutini et al.
8,220,193 B1 * 7/2012 Lynch ..... F41A 17/48 42/70.08
9,046,313 B1 6/2015 Lutton et al.
9,383,153 B2 7/2016 Nebeker et al.
9,441,897 B2 9/2016 Mather et al.
9,810,496 B2 * 11/2017 Kolev ..... F41A 15/14
2010/0024273 A1 * 2/2010 Duperry ..... F41A 19/10 42/69.01
2016/0187092 A1 * 6/2016 Mather ..... F41A 19/10 42/69.02
2018/0080731 A1 * 3/2018 Hudson, III ..... F41A 17/46

FOREIGN PATENT DOCUMENTS

GB 12631 12/1907

* cited by examiner

*Primary Examiner* — Gabriel J Klein
(74) *Attorney, Agent, or Firm* — John A. Chionchio, Esquire; Ballard Spahr LLP

(57) ABSTRACT

A trigger mechanism has a trigger block pivotably mounted on a trigger. The trigger block has a face surface that engages an actuation surface on a plunger which is movable along a line of action. The plunger has a stop surface engageable with a contact surface on the trigger. Pivoting of the trigger is prevented when the stop and contact surfaces are engaged. The plunger is spring biased to maintain the stop surface engaged with the contact surface. Pivoting of the trigger block moves the face surface against the actuation surface, which moves the plunger along its line of action. Motion of the plunger disengages the stop surface from the contact surface allowing the trigger to pivot and discharge the firearm.

21 Claims, 3 Drawing Sheets

TRIGGER ASSEMBLY WITH TRIGGER BLOCK

FIELD OF THE INVENTION

This invention relates to trigger assemblies for firearms.

BACKGROUND

Safety mechanisms for firearms provide an effective means for rendering a firearm incapable of discharging a round when force is applied directly to the firearm's trigger, for example, by the shooter. However, situations arise when a round may be inadvertently discharged even when the safety mechanism is engaged. For example, when a firearm such as a rifle or pistol is dropped, the trigger mechanism is subjected to inertial forces occasioned by rapid deceleration on impact. The sudden jolt may overcome the safety mechanism and cause the firearm to discharge if a round is chambered. There is clearly an opportunity to improve the dependability of firearm safety mechanisms by augmenting their resistance to inadvertent discharge when subject to inertial forces.

SUMMARY

The invention concerns a trigger assembly for a firearm. In one example embodiment the trigger assembly comprises a sear movably mounted within the assembly. The sear has an action surface thereon. A trigger is movably mounted within the assembly. The trigger has a first contact surface movable into and out of engagement with the action surface of the sear upon motion of the trigger. The trigger has a second contact surface thereon. A body is movably mounted within the assembly. The body has an actuation surface and a stop surface thereon. The stop surface is movable into and out of engagement with the second contact surface of the trigger upon motion of the body. Motion of the trigger is prevented when the stop surface engages the second contact surface. A trigger block is movably mounted on the trigger. The trigger block has a finger receiving portion and a face surface. The face surface is movable against the actuation surface upon motion of the trigger block so as to move the body and thereby move the stop surface out of engagement with the second contact surface of the trigger to permit motion of the trigger.

In an example embodiment the sear is pivotably mounted within the assembly. In a further example the trigger is pivotably mounted within the assembly. In a specific example the trigger has a pivot point which coincides with a balance point of the trigger. By way of example the trigger block is pivotably mounted on the trigger. In an example embodiment the trigger block has a pivot point which coincides with a balance point of the trigger block.

In an example embodiment the finger receiving portion is positioned on a first side of the pivot point and the face surface is positioned on a lobe. The lobe is positioned on a second side of the pivot point opposite the first side.

In an example embodiment the body comprises a plunger slidably mounted within the assembly for motion along a line of action. The plunger has a tip on which the actuation surface is positioned. By way of example a spring biases the plunger tip into engagement with the face surface of the trigger block.

In an example embodiment the body comprises a projection mounted on the plunger. The projection is positioned offset from the line of action of the plunger. The stop surface is positioned on the projection. In a further example embodiment the trigger comprises a threaded bore. A set screw threadedly engages within the bore. A notch is positioned in the set screw. The second contact surface is positioned within the notch. Further by way of example a spring biases the first contact surface into engagement with the action surface of the sear.

An example embodiment further comprises first and second side plates arranged in spaced relation to one another. The sear, the trigger, the body and the trigger block are mounted between the side plates.

Another example trigger assembly for a firearm comprises first and second side plates positioned in spaced relation to one another. A sear is mounted on a sear pivot pin extending between the side plates. The sear has an action surface thereon. A trigger is mounted on a trigger pivot pin extending between the side plates. The trigger has a first contact surface movable into and out of engagement with the action surface of the sear upon pivoting of the trigger. The trigger has a second contact surface thereon. A housing is mounted between the side plates. A cavity is positioned within the housing. A plunger is movably mounted within the cavity. The plunger has an actuation surface and a stop surface thereon projecting from the cavity. The stop surface is movable into and out of engagement with the second contact surface of the trigger upon motion of the plunger along a line of action. Motion of the trigger is prevented when the stop surface engages the second contact surface. A spring is positioned within the cavity and biases the stop surface into engagement with the second contact surface. A trigger block is pivotably mounted on the trigger. The trigger block has a finger receiving portion and a face surface thereon. The face surface is movable against the actuation surface upon motion of the trigger block so as to move the plunger and thereby move the stop surface out of engagement with the second contact surface of the trigger to permit motion of the trigger.

In an example embodiment the trigger has a pivot point which coincides with a balance point of the trigger. Further by way of example, the trigger block has a pivot point which coincides with a balance point of the trigger block. In another example embodiment the finger receiving portion is positioned on a first side of the pivot point and the face surface is positioned on a lobe. The lobe is positioned on a second side of the pivot point opposite the first side.

In an example embodiment the plunger has a tip on which the actuation surface is positioned. A further example embodiment comprises a projection mounted on the plunger. The projection is positioned offset from the line of action of the plunger. The stop surface is positioned on the projection.

Another example embodiment further comprises a threaded bore. A set screw is threadedly engaged within the bore. A notch is positioned in the set screw. The second contact surface is positioned within the notch. By way of example a spring is positioned between the housing and the trigger. The spring biases the first contact surface into engagement with the action surface of the sear.

DETAILED DESCRIPTION

Figure 1:
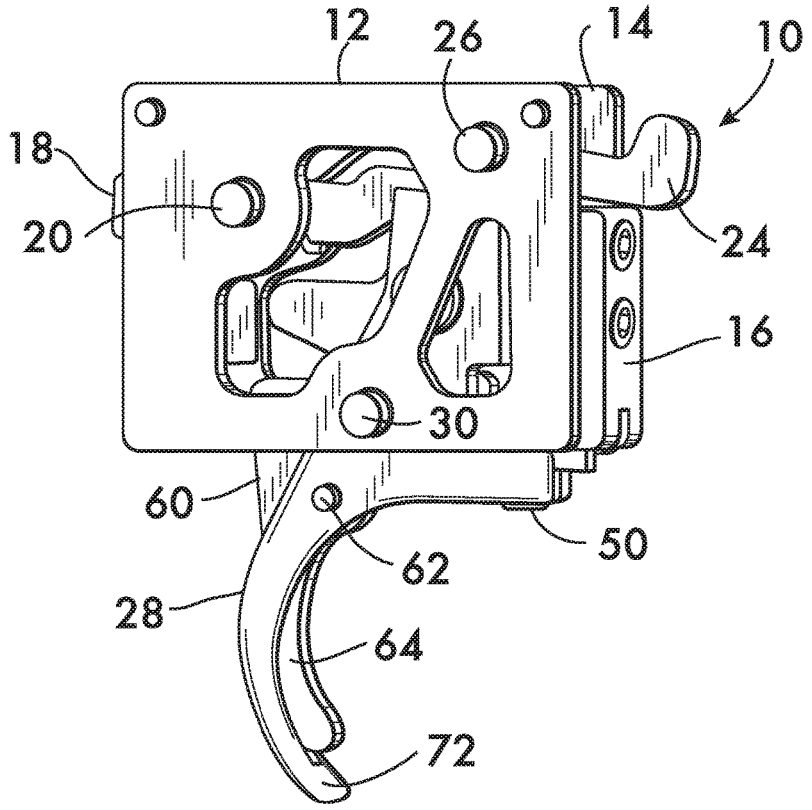
FIG. 1 is an isometric view of an example trigger mechanism according to the invention.
Figure 2A:
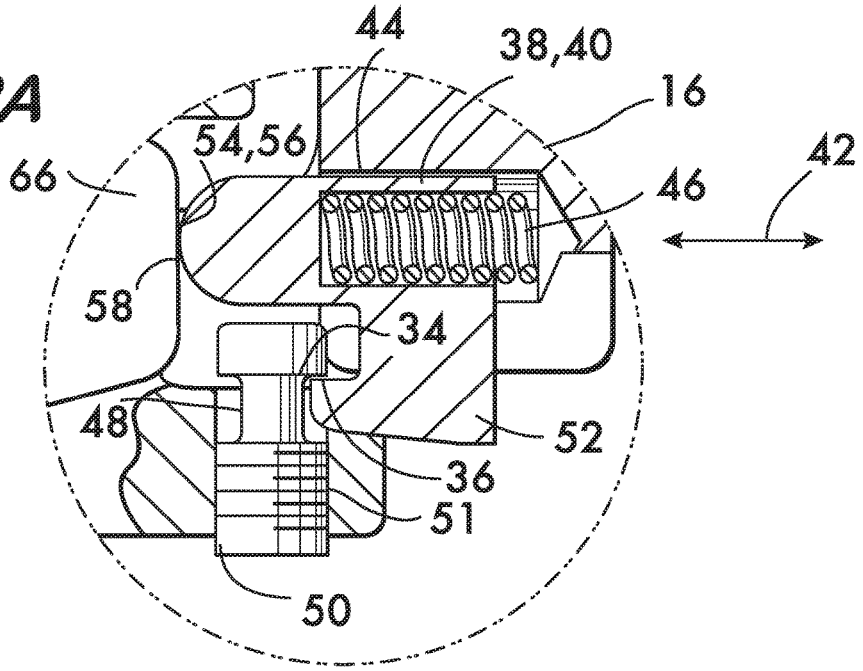
FIG. 2A illustrates a portion of FIG. 2 on an enlarged scale.

FIG. 1 shows an example embodiment of a trigger assembly 10 for use with a firearm, such as a rifle or pistol (not shown). Trigger assembly 10 comprises first and second side plates 12 and 14 positioned in spaced relation adjacent to one another. A housing 16 is mounted between the side plates 12 and 14. As shown in sectional view in FIG. 2, a sear 18 is movably mounted within the assembly 10. In this example embodiment sear 18 is pivotably mounted on a sear pivot pin 20 which extends between the first and second side plates 12 and 14. Sear 18 has an action surface 22 positioned distal to the pivot pin 20. The sear cooperates with a lever 24 (also pivotably mounted between side plates 12 and 14 on a pivot pin 26) which engages a firing mechanism (not shown) to discharge the firearm when the trigger 28 is pulled. Trigger 28 is movably mounted within the assembly 10. In this example embodiment trigger 28 is pivotably mounted on a trigger pivot pin 30 which extends between the side plates 12 and 14. Trigger 28 has a first contact surface 32 which moves into and out of engagement with the action surface 22 of the sear 18 upon motion of the trigger 28 (compare FIGS. 2 and 3). As shown in FIG. 2A, trigger 28 also comprises a second contact surface 34 which is movable into and out of engagement with a stop surface 36 positioned on a body 38 movably mounted within assembly 10. In this example embodiment the body 38 comprises a plunger 40 slidably movable along a line of action 42 within a cavity 44 in housing 16. A spring 46 within the cavity 44 biases the stop surface 36 into engagement with the second contact surface 34 of the trigger 28. By way of example, the second contact surface 34 is positioned within a notch 48 in a set screw 50. Set screw 50 threadedly engages a threaded bore 51 in the trigger 28.

Figure 2:
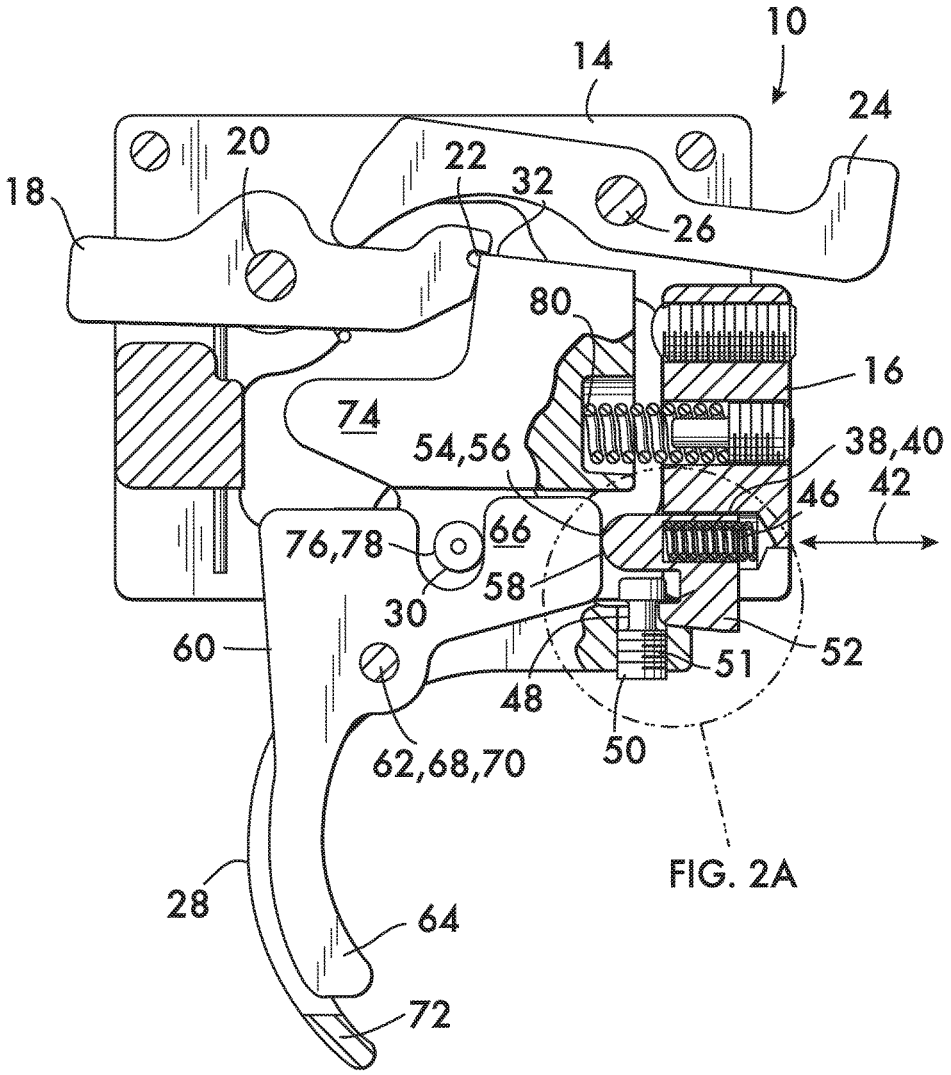
FIGS. 2 and 3 are sectional views of the trigger mechanism shown in FIG. 1.

In the example embodiment shown, plunger 40 comprises a projection 52 mounted offset from the line of action 42 of the plunger 40. The stop surface 36 is positioned on the projection 52. Plunger 40 also has a tip 54 on which an actuation surface 56 is positioned. As shown in FIGS. 2 and 2A, actuation surface 56 engages a face surface 58 positioned on a trigger block 60. Trigger block 60 is movably mounted on trigger 28, in this example, pivotably mounted on a pivot pin 62 passing though the trigger block 60 and the trigger 28. Trigger block 60 comprises a finger receiving portion 64, positioned on a first side of the pivot pin 62, and a lobe 66 positioned on a second side of the pivot pin 62 opposite to the first side. The face surface 58 is positioned on the lobe 66. Lobe 66 may function as a counter-mass against the finger receiving portion 64 and may be sized such that the balance point 68 of the trigger block coincides with its pivot point 70. Similarly, trigger 28 comprises a finger receiving portion 72 and a counter-mass 74 on opposite sides of the pivot point 76 which permits the trigger to be designed so that its balance point 78 coincides with the pivot point 76. Having coincident balance and pivot points on one or both of the trigger 28 and trigger block 60 helps reduce any torque applied to the trigger 28 when the trigger assembly 10 experiences inertial loads, as when the firearm in which the trigger assembly is mounted is dropped, thus reducing the potential for accidental discharge of the firearm.

Spring 46 biases the plunger tip 54, and consequently the actuation surface 56 thereon into engagement with the face surface 58 of the trigger block 60. Trigger assembly 10 also comprises another spring 80 which acts between housing 16 and trigger 28 to bias the first contact surface 32 of the trigger 28 into engagement with the action surface 22 of the sear 18.

Operation of the trigger assembly 10 is described with reference to FIGS. 2 and 3. As shown in FIG. 2, the trigger assembly is in the "ready to fire" configuration with the action surface 22 of the sear 18 engaged with the first contact surface 32 of the trigger 28. Sear 18 supports the lever 24, which may, for example, hold a firing pin of the firearm in the cocked position such that when the action surface 22 falls off the first contact surface 32 (upon pivoting of the trigger 28) the lever 24 is no longer supported and is free to pivot about its pivot pin 26 to release the firing pin (not shown). As further shown in FIG. 2 the second contact surface 34 of the trigger 28 engages the stop surface 36 of the projection 52 extending from plunger 40. This engagement between contact surface 34 and stop surface 36 prevents the trigger 28 from pivoting about its pivot pin 30 and discharging the firearm. FIG. 2 also shows the face surface 58 on lobe 66 of the trigger block 60 engaging the actuation surface 56 on the tip 54 of the plunger 40, the spring 46 biasing the plunger along its line of action 42 toward the trigger block 60. Thus in the configuration shown in FIG. 2, the trigger 28 is positively locked and, because both the trigger 28 and the trigger block 60 are balanced about their respective pivot points 76 and 70, the trigger assembly 10 will resist accidental discharge due to inertial loads induced when the firearm is dropped.

Figure 3:
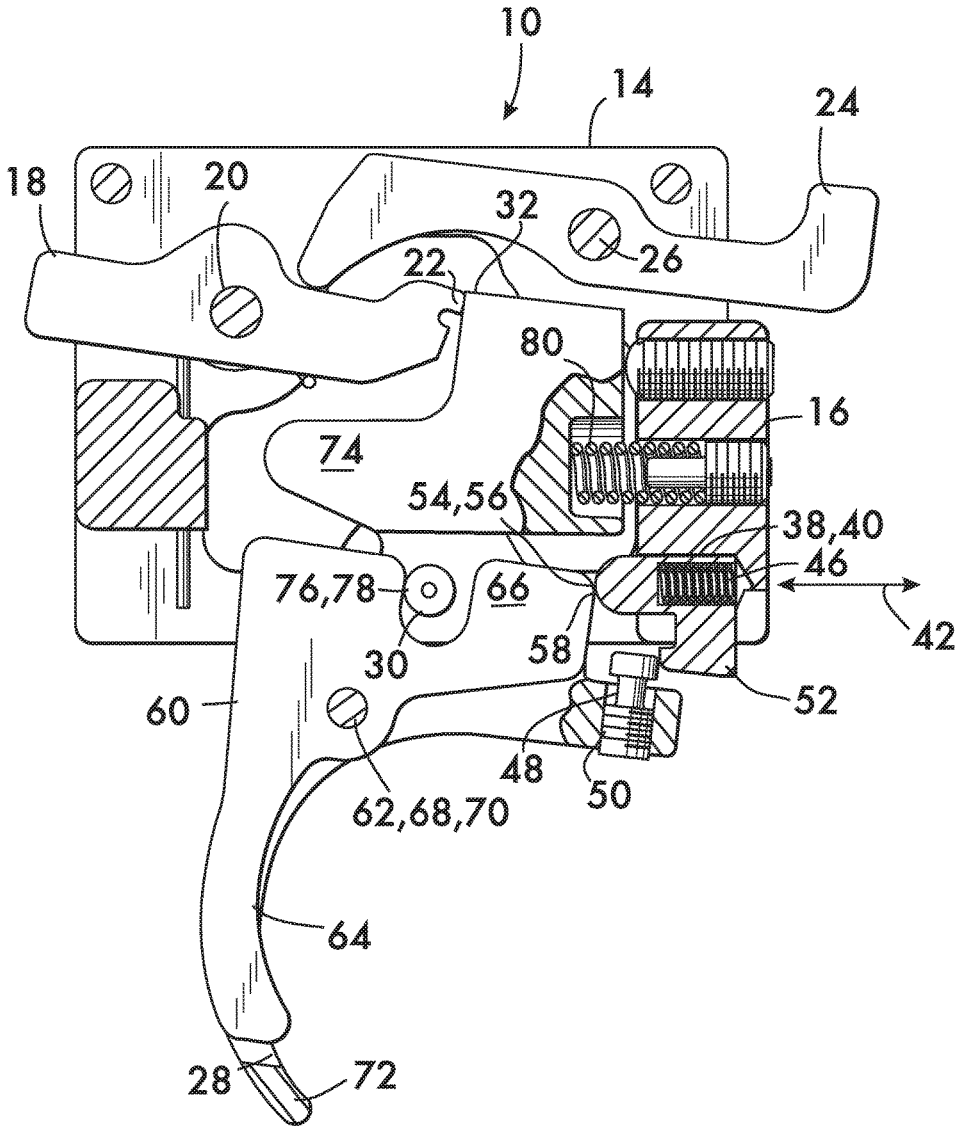

FIG. 3 shows the configuration of the trigger assembly after the trigger 28 has been pulled to discharge the firearm. To pull trigger 28 the trigger block 60 must first be pivoted clockwise by applying force to the finger receiving portion 64. This is possible because the finger receiving portion 64 of the trigger block 60 extends outwardly from the finger receiving portion 72 of the trigger 28 (see FIG. 1 also). Force applied to the finger receiving portion 64 of trigger block 60 pivots the trigger block about its pivot point 70 on pivot pin 62. Pivoting of the trigger block causes face surface 58 on lobe 66 to engage the actuation surface 56 on plunger 40, which pushes the plunger along line of action 42 against its biasing spring 46. Motion of plunger 40 moves the stop surface 36 on projection 52 out of engagement with the second contact surface 34 on trigger 28. Once these surfaces disengage the trigger 28 is free to pivot about its pivot point 76 on pivot pin 30. Additional force applied now to the trigger's finger receiving portion 72 will rotate the trigger 28 clockwise and permit the action surface 22 of sear 18 to fall off of the first contact surface 32 of the trigger and release lever 24. Lever 24 in turn releases the firing pin (not shown) to discharge the firearm.

Trigger mechanisms according to the invention are expected to effectively inhibit accidental discharge of firearms when subjected to inertial forces.

What is claimed is:

1. A trigger assembly for a firearm, said trigger assembly comprising:

a sear movably mounted within said assembly, said sear having an action surface thereon;

a trigger movably mounted within said assembly, said trigger having a first contact surface movable into and out of engagement with said action surface of said sear upon motion of said trigger, said trigger having a second contact surface thereon;

a body movably mounted within said assembly, said body having an actuation surface and a stop surface thereon, said stop surface being movable into and out of engagement with said second contact surface of said trigger upon motion of said body, motion of said trigger being prevented when said stop surface engages said second contact surface;

a trigger block movably mounted on said trigger, said trigger block having a finger receiving portion and a face surface, said face surface being movable against said actuation surface upon motion of said trigger block so as to move said body and thereby move said stop surface out of engagement with said second contact surface of said trigger to permit motion of said trigger.

2. The trigger assembly according to claim 1, wherein said sear is pivotably mounted within said assembly.

3. The trigger assembly according to claim 1, wherein said trigger is pivotably mounted within said assembly.

4. The trigger assembly according to claim 3, wherein said trigger has a pivot point which coincides with a balance point of said trigger.

5. The trigger assembly according to claim 1, wherein said trigger block is pivotably mounted on said trigger.

6. The trigger assembly according to claim 5, wherein said trigger block has a pivot point which coincides with a balance point of said trigger block.

7. The trigger assembly according to claim 6, wherein said finger receiving portion is positioned on a first side of said pivot point and said face surface is positioned on a lobe, said lobe being positioned on a second side of said pivot point opposite said first side.

8. The trigger assembly according to claim 1, wherein said body comprises a plunger slidably mounted within said assembly for motion along a line of action, said plunger having a tip on which said actuation surface is positioned.

9. The trigger assembly according to claim 8, further comprising a spring biasing said plunger tip into engagement with said face surface of said trigger block.

10. The trigger assembly according to claim 8, wherein said body comprises a projection mounted on said plunger, said projection being positioned offset from said line of action of said plunger, said stop surface being positioned on said projection.

11. The trigger assembly according to claim 1, wherein said trigger further comprises:

a threaded bore;

a set screw threadedly engaged within said bore;

a notch positioned in said set screw, said second contact surface being positioned within said notch.

12. The trigger assembly according to claim 1, further comprising a spring biasing said first contact surface into engagement with said action surface of said sear.

13. The trigger assembly according to claim 1, further comprising first and second side plates arranged in spaced relation to one another, said sear, said trigger, said body and said trigger block being mounted between said side plates.

14. A trigger assembly for a firearm, said trigger assembly comprising:

first and second side plates positioned in spaced relation to one another;

a sear mounted on a sear pivot pin extending between said side plates, said sear having an action surface thereon;

a trigger mounted on a trigger pivot pin extending between said side plates, said trigger having a first contact surface movable into and out of engagement with said action surface of said sear upon pivoting of said trigger, said trigger having a second contact surface thereon;

a housing mounted between said side plates, a cavity being positioned within said housing;

a plunger movably mounted within said cavity, said plunger having an actuation surface and a stop surface thereon projecting from said cavity, said stop surface being movable into and out of engagement with said second contact surface of said trigger upon motion of said plunger along a line of action, motion of said trigger being prevented when said stop surface engages said second contact surface;

a spring positioned within said cavity and biasing said stop surface into engagement with said second contact surface;

a trigger block pivotably mounted on said trigger, said trigger block having a finger receiving portion and a face surface thereon, said face surface being movable against said actuation surface upon motion of said trigger block so as to move said plunger and thereby move said stop surface out of engagement with said second contact surface of said trigger to permit motion of said trigger.

15. The trigger assembly according to claim 14, wherein said trigger has a pivot point which coincides with a balance point of said trigger.

16. The trigger assembly according to claim 14, wherein said trigger block has a pivot point which coincides with a balance point of said trigger block.

17. The trigger assembly according to claim 16, wherein said finger receiving portion is positioned on a first side of said pivot point and said face surface is positioned on a lobe, said lobe being positioned on a second side of said pivot point opposite said first side.

18. The trigger assembly according to claim 14, wherein said plunger has a tip on which said actuation surface is positioned.

19. The trigger assembly according to claim 14, further comprising a projection mounted on said plunger, said projection being positioned offset from said line of action of said plunger, said stop surface being positioned on said projection.

20. The trigger assembly according to claim 14, wherein said trigger further comprises:

a threaded bore;

a set screw threadedly engaged within said bore;

a notch positioned in said set screw, said second contact surface being positioned within said notch.

21. The trigger assembly according to claim 14, further comprising a spring positioned between said housing and said trigger, said spring biasing said first contact surface into engagement with said action surface of said sear.

* * * * *